US008167703B2

(12) United States Patent
Gagner et al.

(10) Patent No.: US 8,167,703 B2
(45) Date of Patent: May 1, 2012

(54) GAMING SYSTEM HAVING ALTERNATE WAGERING GAME CONFIGURATIONS

(75) Inventors: Mark B. Gagner, West Chicago, IL (US); Vernon W. Hamlin, Lisle, IL (US); Craig J. Sylla, Round Lake, IL (US); Matthew J. Ward, Northbrook, IL (US)

(73) Assignee: WMS Gaming Inc., Waukegan, IL (US)

( * ) Notice: Subject to any disclaimer, the term of this patent is extended or adjusted under 35 U.S.C. 154(b) by 405 days.

(21) Appl. No.: 12/410,914

(22) Filed: Mar. 25, 2009

(65) Prior Publication Data

US 2009/0253487 A1 Oct. 8, 2009

Related U.S. Application Data

(60) Provisional application No. 61/072,753, filed on Apr. 2, 2008.

(51) Int. Cl.
*A63F 9/24* (2006.01)

(52) U.S. Cl. ..... 463/20

(58) Field of Classification Search ..... 463/20
See application file for complete search history.

(56) References Cited

U.S. PATENT DOCUMENTS

| | | | | |
|---|---|---|---|---|
| 6,117,011 | A | 9/2000 | Lvov | |
| 7,431,650 | B2 | 10/2008 | Kessman et al. | |
| 2002/0147049 | A1 | 10/2002 | Carter, Sr. | |
| 2003/0130029 | A1 | 7/2003 | Crumby | |
| 2004/0242329 | A1 | 12/2004 | Blackburn et al. | |
| 2004/0243848 | A1 | 12/2004 | Blackburn et al. | |
| 2004/0266533 | A1 | 12/2004 | Gentles et al. | |
| 2005/0096124 | A1 | 5/2005 | Stronach | |
| 2005/0159212 | A1 | 7/2005 | Romney et al. | |
| 2007/0013133 | A1 | 1/2007 | Novellie et al. | |
| 2007/0082730 | A1 * | 4/2007 | Brown | 463/25 |
| 2007/0105618 | A1 | 5/2007 | Steil | |
| 2007/0111798 | A1 | 5/2007 | Robb et al. | |
| 2007/0232397 | A1 * | 10/2007 | Katz | 463/42 |
| 2007/0274488 | A1 * | 11/2007 | Callaghan | 379/201.01 |
| 2008/0058097 | A1 | 3/2008 | Martinek et al. | |
| 2008/0176637 | A1 | 7/2008 | Letovsky et al. | |
| 2008/0293494 | A1 | 11/2008 | Adiraju et al. | |
| 2008/0305856 | A1 | 12/2008 | Walker et al. | |
| 2009/0005170 | A9 | 1/2009 | Kelly et al. | |
| 2009/0069094 | A1 | 3/2009 | Brosnan et al. | |

FOREIGN PATENT DOCUMENTS

| | | | |
|---|---|---|---|
| WO | WO 2007/095368 A2 | 8/2007 | |

OTHER PUBLICATIONS

ACDIS Occasional Paper; Destructive Economic Policies in the Age of Terrorism: Government-Sanctioned Gambling as Encouraging Transboundary Economic Raiding and Destabilizing National and International Economies; John Watten Kindt, Professor, University of Illinois at Urbana-Champaign; 41 pages; dated Oct. 2005.

NokiaResearch center; Mobile Games 2010, Elina Koivisto, Nokia Research Center Finland; 43 pages; dated Jan. 1, 2007.

* cited by examiner

*Primary Examiner* — William D Coleman
(74) *Attorney, Agent, or Firm* — Nixon Peabody LLP

(57) ABSTRACT

A method of playing a wagering game comprises permitting a first configuration of the wagering game to be played via a gaming terminal, detecting a loss of communication between the gaming terminal and a server, and in response to detecting the loss of communication, permitting a second configuration of the wagering game to be played via the gaming terminal.

25 Claims, 8 Drawing Sheets

GAMING SYSTEM HAVING ALTERNATE WAGERING GAME CONFIGURATIONS

CROSS-REFERENCE TO RELATED APPLICATION

This application claims the benefit of U.S. Provisional Application Ser. No. 61/072,753, filed Apr. 2, 2008, entitled "Gaming System Having Alternate Wagering Game Configurations."

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming systems, and methods for playing wagering games, and more particularly, to gaming systems having alternate configurations of wagering games.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options.

Gaming systems may include a variety of servers, gaming terminals and other networked devices. As gaming systems grow in size and number of components, the complexity of managing such systems increases. Thus, systems need to evolve to include safeguards against communications interruptions within the network.

SUMMARY OF THE INVENTION

According to one aspect of the present invention, a method of playing a wagering game comprises permitting a first configuration of the wagering game to be played via a gaming terminal, detecting a loss of communication between the gaming terminal and a server, and in response to detecting the loss of communication, permitting a second configuration of the wagering game to be played via the gaming terminal.

According to another aspect of the invention, a gaming system comprises at least one wager input device, at least one gaming terminal including a display, at least one controller. The at least one controller is operative to (i) execute a wagering game, and cause the at least one gaming terminal to present a first configuration of the wagering game, (ii) detect a loss of communication between the gaming terminal and a server, and (iii) in response to detecting the loss of communication, cause the at least one gaming terminal to present a second configuration of the wagering game.

According to yet another aspect of the invention, a method of playing a wagering game comprises executing and presenting a first configuration of the wagering game on a gaming terminal, detecting a loss of a system resource of the gaming terminal, and in response to detecting the loss of the system resource, executing and presenting a second configuration of the wagering game on the gaming terminal.

According to yet another aspect of the invention, a gaming system comprises at least one gaming terminal including a display for displaying a wagering game, the at least one gaming terminal further comprising a plurality of system resources, and at least one controller. The at least one controller is operative to (i) determine which of the plurality of system resources are operational, (ii) select a configuration of the wagering game in accordance with at least one rule set, the selection dependent at least in part the operational system resources, and (iii) execute the wagering game, and cause the display to display the selected configuration of the wagering game.

According to yet another aspect of the invention, a gaming system comprises a server for communicating with a plurality of gaming terminals, each of the plurality of gaming terminals displaying a community wagering game, at least one data storage element in communication with the server, the at least one data storage element storing at least one wagering game, and at least one controller. The at least one controller is operative to (i) execute at least a portion of the community wagering game and transmit information related thereto to each of the plurality of gaming terminals, (ii) monitor a connection between the server and each of the gaming terminals, (iii) detect a loss of communication between a first one of the gaming terminals and the server, (iv) in response to the detection, modify a configuration of the community wagering game, and (v) transmit the modified configuration of the community wagering game to a remainder of the plurality of gaming terminals.

According to yet another aspect of the invention, one or more computer readable storage media is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

Figure 1A:
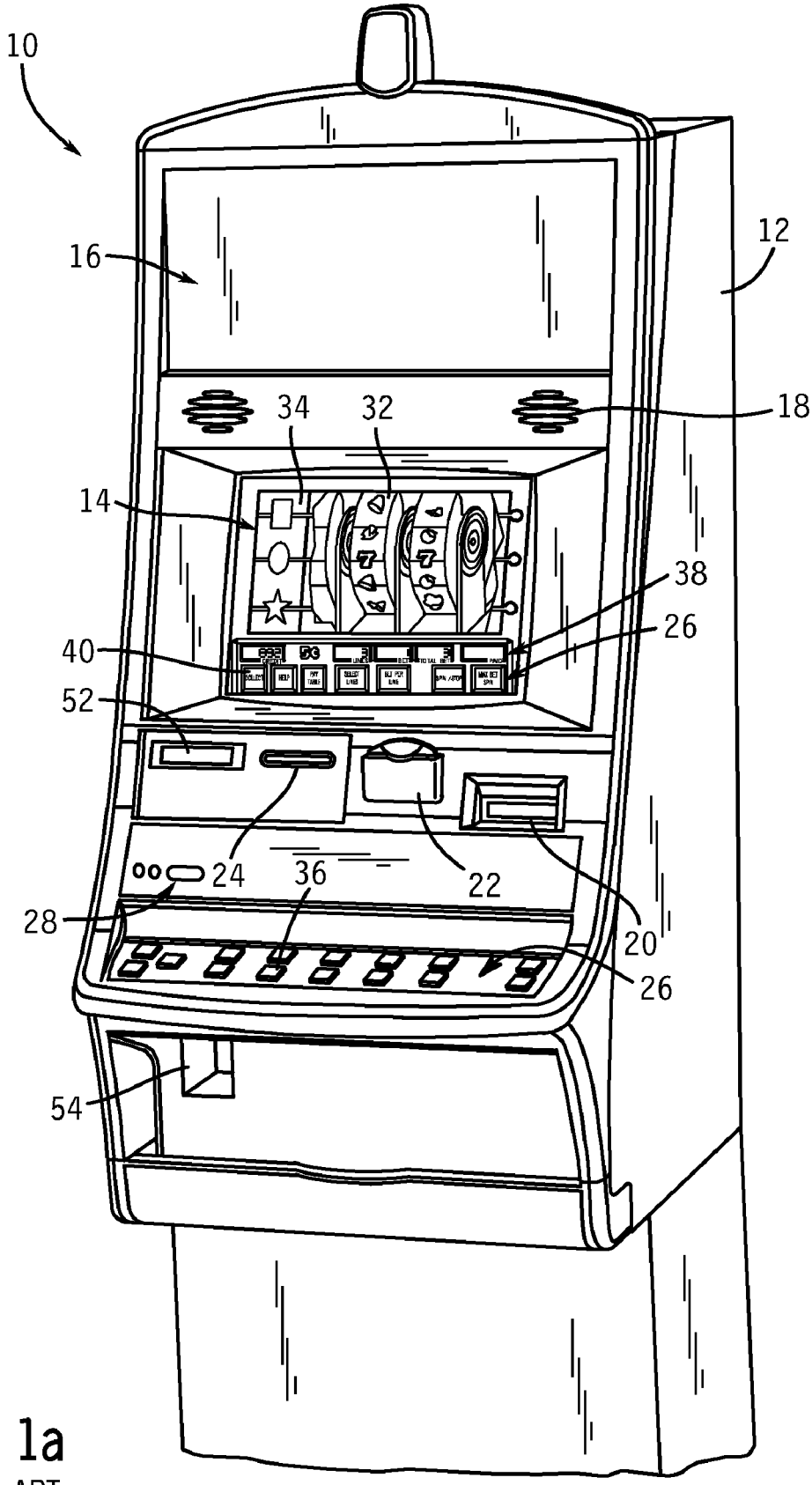
FIG. 1a PRIOR ART
FIG. 1*a* is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 1B:
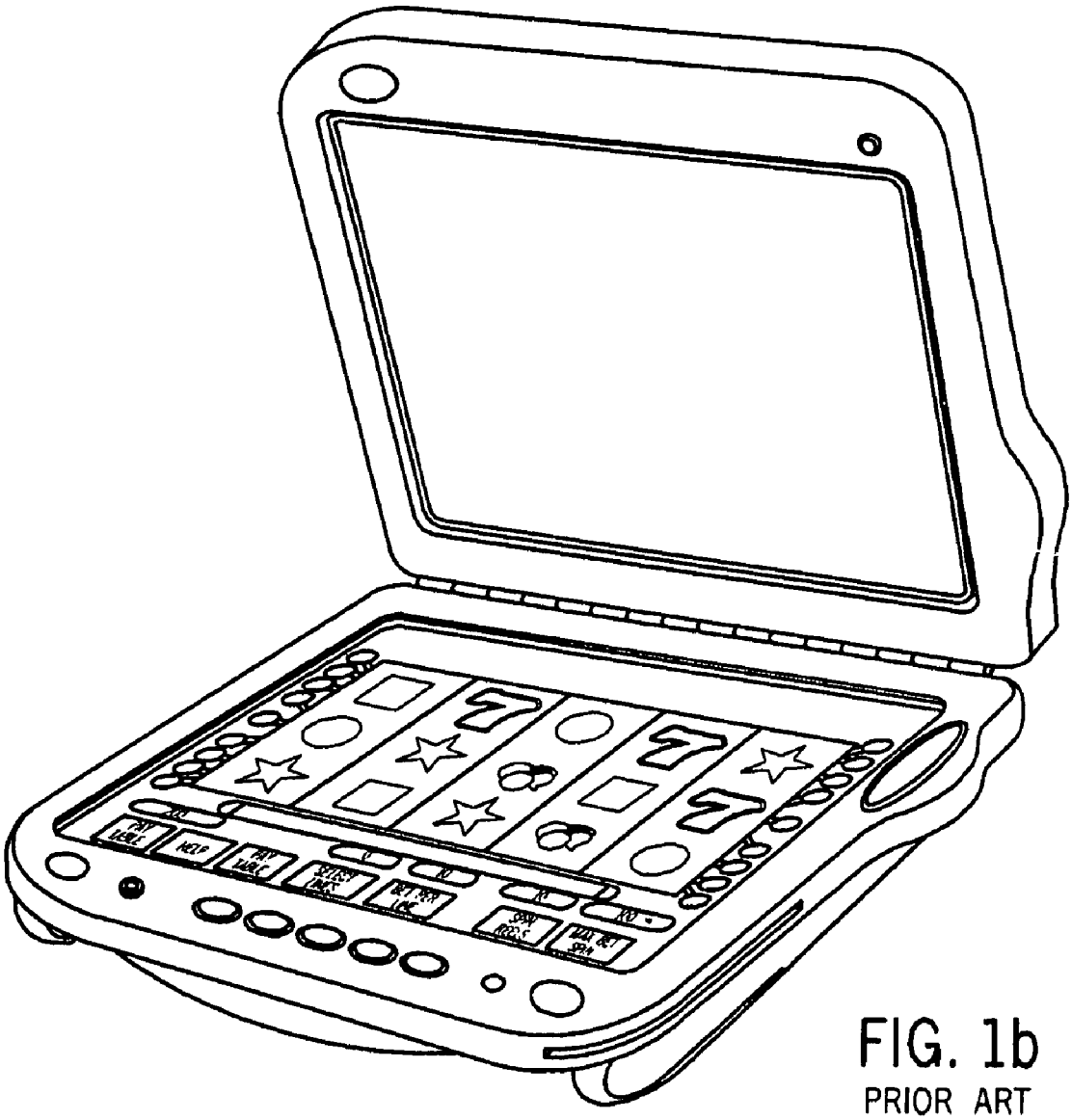
FIG. 1b PRIOR ART
FIG. 1*b* is a perspective view of a handheld gaming terminal according to an embodiment of the present invention.

Referring to FIG. 1*a*, there is shown a gaming terminal 10 similar to those used in gaming establishments, such as casinos. With regard to the present invention, the gaming terminal 10 may be any type of gaming terminal and may have varying structures and methods of operation. For example, the gaming terminal 10 may be an electromechanical gaming terminal configured to play mechanical slots, or it may be an electronic gaming terminal configured to play a video casino game, such as slots, keno, poker, blackjack, roulette, craps, etc. It should be understood that although the gaming terminal 10 is shown as a free-standing terminal of the upright type, it may take on a wide variety of other forms such as a free-standing terminal of the slant-top type, a portable or handheld device primarily used for gaming as shown in FIG. 1*b*, a mobile telecommunications device such as a mobile telephone or personal digital assistant (PDA), a counter-top or bar-top gaming terminal, or other personal electronic device such as a portable television, MP3 player, entertainment device, etc.

The illustrated gaming terminal 10 comprises a cabinet or housing 12. For output devices, the gaming terminal 10 may include a primary display area 14, a secondary display area 16, and one or more audio speakers 18. The primary display area 14 and/or secondary display area 16 may display information associated with wagering games, non-wagering games, community games, progressives, advertisements, services, premium entertainment, text messaging, emails, alerts or announcements, broadcast information, subscription information, etc. For input devices, the gaming terminal 10 may include a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements may exist and may be used in any number of combinations to create various forms of a gaming terminal.

The primary display area 14 may include a mechanical-reel display, a video display, or a combination thereof in which a transmissive video display in front of the mechanical-reel display portrays a video image superimposed over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display may be a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10. The primary display area 14 may include one or more paylines 30 (see FIG. 3) extending along a portion thereof. In the illustrated embodiment, the primary display area 14 comprises a plurality of mechanical reels 32 and a video display 34 such as a transmissive display (or a reflected image arrangement in other embodiments) in front of the mechanical reels 32. If the wagering game conducted via the gaming terminal 10 relies upon the video display 34 only and not the mechanical reels 32, the mechanical reels 32 may be removed from the interior of the terminal and the video display 34 may be of a non-transmissive type. Similarly, if the wagering game conducted via the gaming terminal 10 relies upon the mechanical reels 32 but not the video display 34, the video display 34 may be replaced with a conventional glass panel. Further, the underlying mechanical-reel display may be replaced with a video display such that the primary display area 14 includes layered video displays, or may be replaced with another mechanical or physical member such as a mechanical wheel (e.g., a roulette game), dice, a pachinko board, or a diorama presenting a three-dimensional model of a game environment.

Video images in the primary display area 14 and/or the secondary display area 16 may be rendered in two-dimensional (e.g., using Flash Macromedia™) or three-dimensional graphics (e.g., using Renderware™). The images may be played back (e.g., from a recording stored on the gaming terminal 10), streamed (e.g., from a gaming network), or received as a TV signal (e.g., either broadcast or via cable). The images may be animated or they may be real-life images, either prerecorded (e.g., in the case of marketing/promotional material) or as live footage, and the format of the video images may be an analog format, a standard digital format, or a high-definition (HD) digital format.

The player-input devices 26 may include a plurality of buttons 36 on a button panel and/or a touch screen 38 mounted over the primary display area 14 and/or the secondary display area 16 and having one or more soft touch keys 40. The player-input devices 26 may further comprise technologies that do not rely upon touching the gaming terminal, such as speech-recognition technology, gesture-sensing technology, eye-tracking technology, etc.

The information reader 24 is preferably located on the front of the housing 12 and may take on many forms such as a ticket reader, card reader, bar code scanner, wireless transceiver (e.g., RFID, Bluetooth, etc.), biometric reader, or computer-readable-storage-medium interface. Information may be transmitted between a portable medium (e.g., ticket, voucher, coupon, casino card, smart card, debit card, credit card, etc.) and the information reader 24 for accessing an account associated with cashless gaming, player tracking, game customization, saved-game state, data transfer, and casino services as more fully disclosed in U.S. Patent Publication No. 2003/0045354 entitled "Portable Data Unit for Communicating With Gaming Machine Over Wireless Link," which is incorporated herein by reference in its entirety. The account may be stored at an external system 46 (see FIG. 2) as more fully disclosed in U.S. Pat. No. 6,280,328 to Holch et al. entitled "Cashless Computerized Video Game System and Method," which is incorporated herein by referenced in its entirety, or directly on the portable medium. To enhance security, the individual carrying the portable medium may be required to enter a secondary independent authenticator (e.g., password, PIN number, biometric, etc.) to access their account.

FIG. 1*b* illustrates a portable or handheld device primarily used to display and/or conduct wagering games. The handheld device may incorporate the same features as the gaming terminal 10 or variations thereof. A more detailed description of a handheld device that may be utilized with the present invention can be found in PCT Patent Application No. PCT/

US2007/000792 filed Jan. 26, 2007, entitled "Handheld Device for Wagering Games," which is incorporated herein by reference in its entirety.

Figure 2:
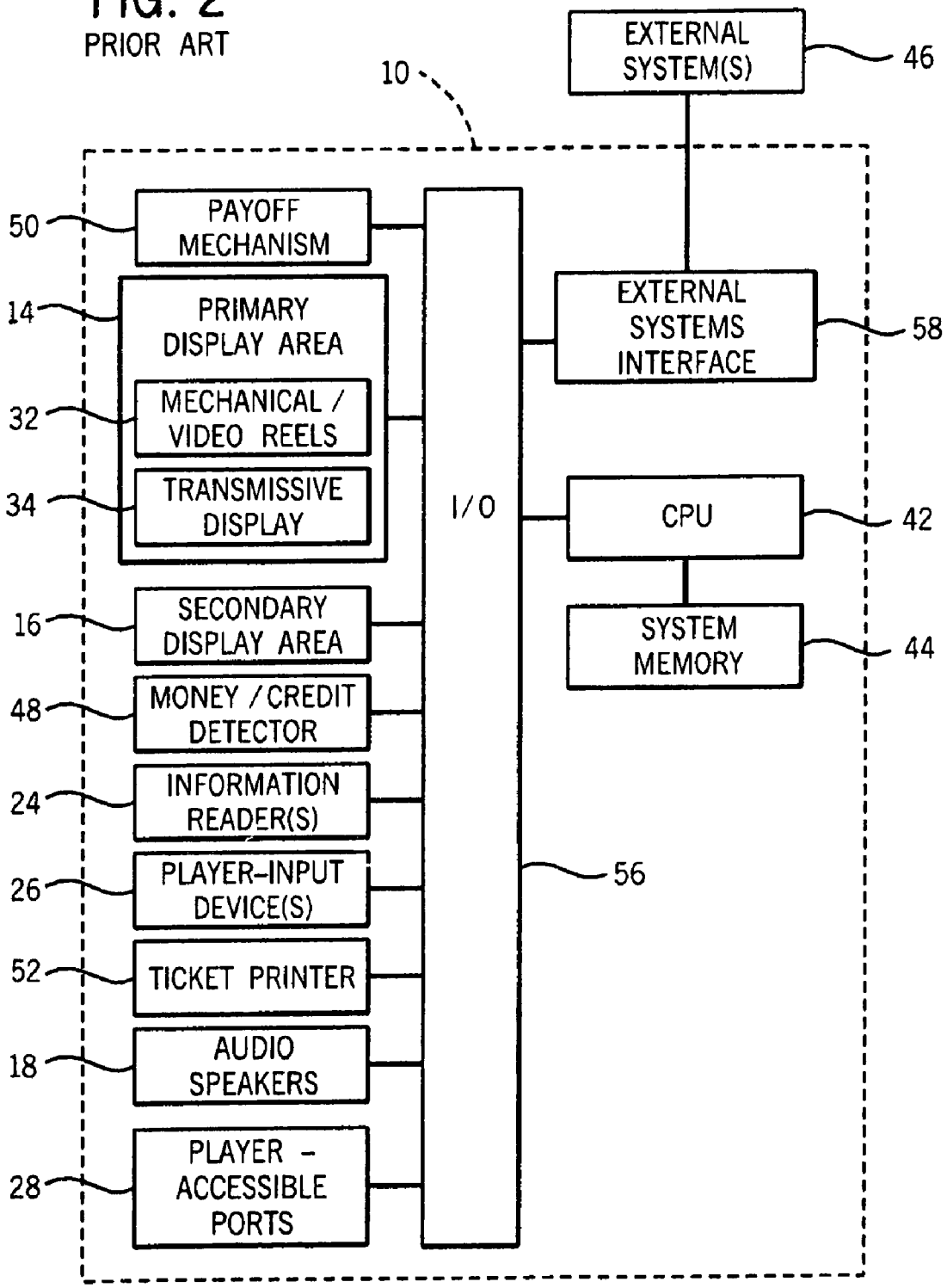
FIG. 2 PRIOR ART
FIG. 2 is a schematic view of a gaming system according to an embodiment of the present invention.

Turning now to FIG. 2, the various components of the gaming terminal 10 are controlled by a central processing unit (CPU) 42, also referred to herein as a controller or processor (such as a microcontroller or microprocessor). The CPU 42 can include any suitable processor, such as an Intel® Pentium processor, Intel® Core 2 Duo processor, AMD Opteron™ processor, or UltraSPARC® processor. To provide gaming functions, the controller 42 executes one or more game programs stored in one or more computer readable storage media in the form of memory 44 or other suitable storage device. The controller 42 uses a random number generator (RNG) to randomly generate a wagering game outcome from a plurality of possible outcomes. Alternatively, the outcome may be centrally determined using either an RNG or pooling scheme at a remote controller included, for example, within the external system 46. It should be appreciated that the controller 42 may include one or more microprocessors, including but not limited to a master processor, a slave processor, and a secondary or parallel processor.

The controller 42 is coupled to the system memory 44 and also to a money/credit detector 48. The system memory 44 may comprise a volatile memory (e.g., a random-access memory (RAM)) and a non-volatile memory (e.g., an EEPROM). The system memory 44 may include multiple RAM and multiple program memories. The money/credit detector 48 signals the processor that money and/or credits have been input via a value-input device, such as the bill validator 20, coin acceptor 22, or via other sources, such as a cashless gaming account, etc. These components may be located internal or external to the housing 12 of the gaming terminal 10 and connected to the remainder of the components of the gaming terminal 10 via a variety of different wired or wireless connection methods. The money/credit detector 48 detects the input of funds into the gaming terminal 10 (e.g., via currency, electronic funds, ticket, card, etc.) that are generally converted into a credit balance available to the player for wagering on the gaming terminal 10. The credit detector 48 detects when a player places a wager (e.g., via a player-input device 26) to play the wagering game, the wager then generally being deducted from the credit balance. The money/credit detector 48 sends a communication to the controller 42 that a wager has been detected and also communicates the amount of the wager.

As seen in FIG. 2, the controller 42 is also connected to, and controls, the primary display area 14, the player-input device 26, and a payoff mechanism 50. The payoff mechanism 50 is operable in response to instructions from the controller 42 to award a payoff to the player in response to certain winning outcomes that might occur in the base game, the bonus game (s), or via an external game or event. The payoff may be provided in the form of money, redeemable points, services or any combination thereof. Such payoff may be associated with a ticket (from a ticket printer 52), portable data unit (e.g., a card), coins, currency bills, accounts, and the like. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+ frontside bus and a PCI backside bus. Although the I/O circuit 56 is shown as a single block, it should be appreciated that the I/O circuit 56 may include a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface 58, which is connected to the external system 46. The controller 42 communicates with the external system 46 via the external system interface 58 and a communication path (e.g., serial, parallel, IR, RC, 10bT, etc.). The external system 46 may include a gaming network, other gaming terminals, a gaming server, a remote controller, communications hardware, or a variety of other interfaced systems or components.

Controller 42, as used herein, comprises any combination of hardware, software, and/or firmware that may be disposed or resident inside and/or outside of the gaming terminal 10 and may communicate with and/or control the transfer of data between the gaming terminal 10 and a bus, another computer, processor, or device and/or a service and/or a network. The controller 42 may comprise one or more controllers or processors. In FIG. 2, the controller 42 in the gaming terminal 10 is depicted as comprising a CPU, but the controller 42 may alternatively comprise a CPU in combination with other components, such as the I/O circuit 56 and the system memory 44. The controller 42 is operable to execute all of the various gaming methods and other processes disclosed herein.

The gaming terminal 10 may communicate with external system 46 (in a wired or wireless manner) such that each terminal operates as a "thin client" having relatively less functionality, a "thick client" having relatively more functionality, or with any range of functionality therebetween (e.g., a "rich client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets may be contained within the gaming terminal 10 ("thick client" gaming terminal), the external systems 46 ("thin client" gaming terminal), or distributed therebetween in any suitable manner ("rich client" gaming terminal).

Figure 3:
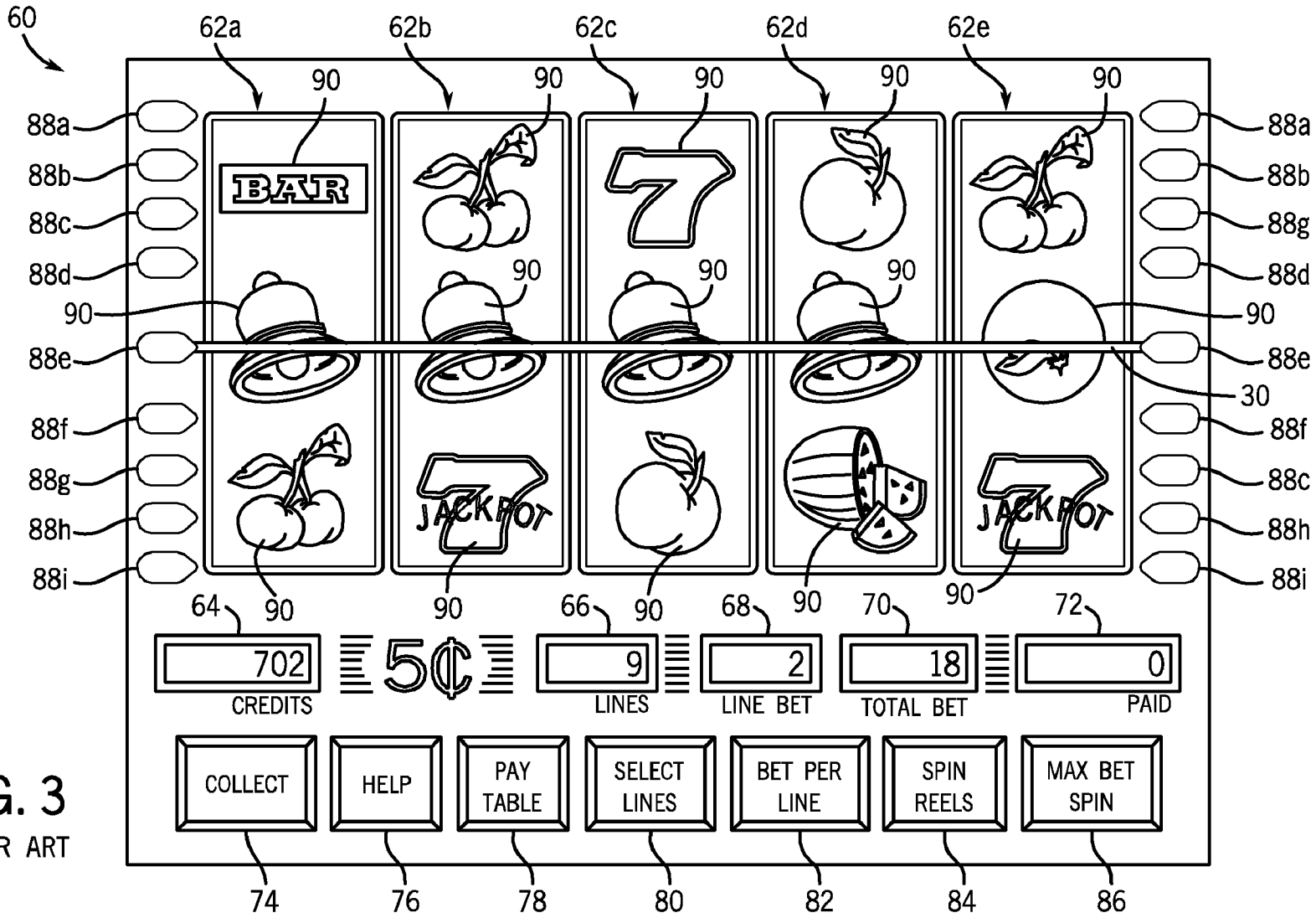
FIG. 3 PRIOR ART
FIG. 3 is an image of a basic-game screen of a wagering game that may be displayed on a gaming terminal, according to an embodiment of the present invention.

Referring now to FIG. 3, an image of a basic-game screen 60 adapted to be displayed on the primary display area 14 is illustrated, according to one embodiment of the present invention. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

The basic-game screen 60 may be displayed on the primary display area 14 or a portion thereof. In FIG. 3, the basic-game screen 60 portrays a plurality of simulated movable reels 62*a-e*. Alternatively or additionally, the basic-game screen 60 may portray a plurality of mechanical reels. The basic-game screen 60 may also display a plurality of game-session meters and various buttons adapted to be actuated by a player.

In the illustrated embodiment, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The user-selectable buttons may include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present invention does not require them and can be used on gaming terminals having more, less, or different player inputs.

Paylines 30 may extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations may be evaluated as line pays or scatter pays. Line pays may be evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with the present invention. Additionally, though an embodiment with five reels is shown, a gaming terminal with any plurality of reels may also be used in accordance with the present invention.

Figure 4:
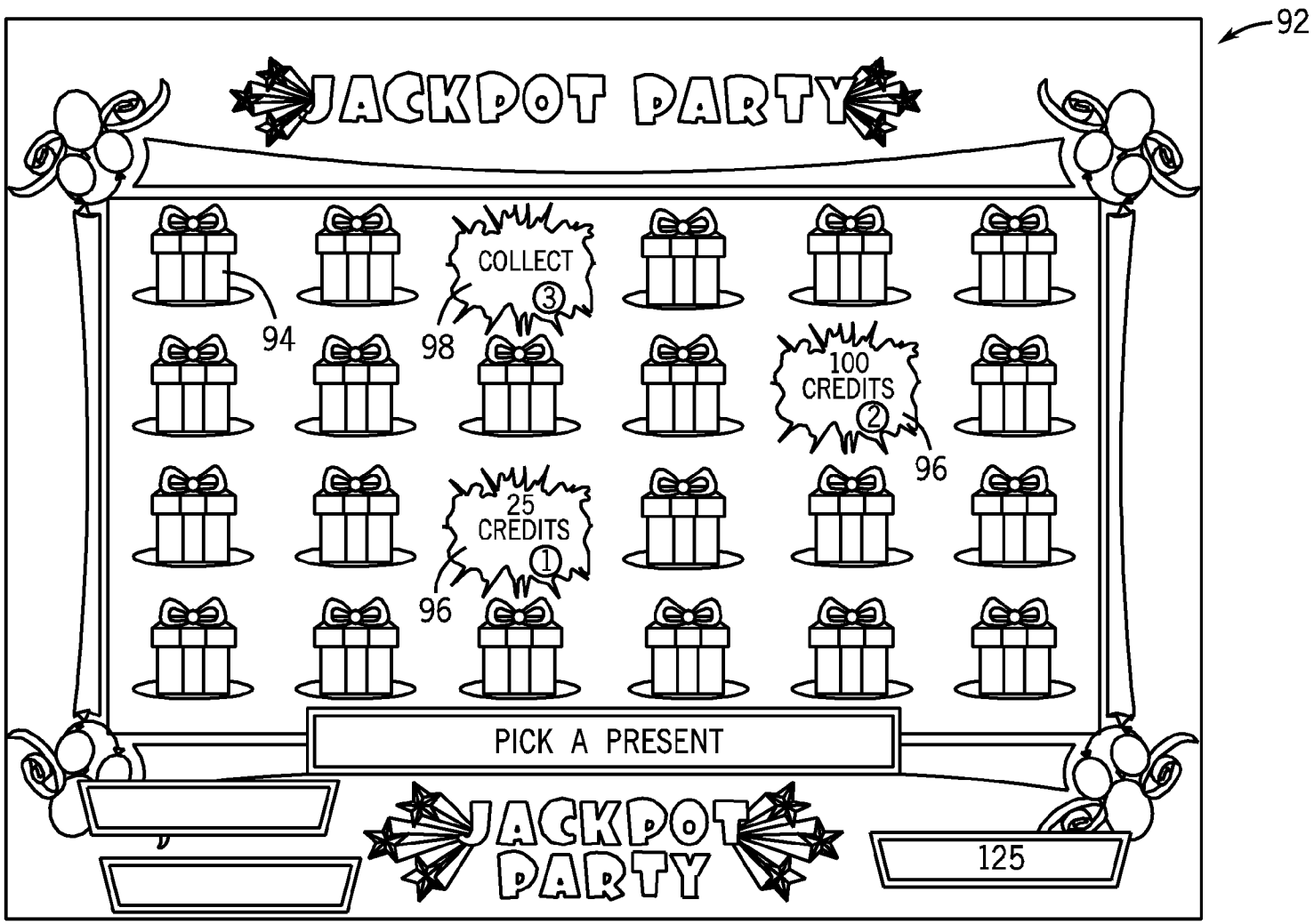
FIG. 4 PRIOR ART
FIG. 4 is an image of a bonus-game screen of a wagering game that may be displayed on a gaming terminal, according to an embodiment of the present invention.

Turning now to FIG. 4, a bonus game that may be included with a basic wagering game is illustrated, according to one embodiment. A bonus-game screen 92 includes an array of markers 94 located in a plurality of columns and rows. The bonus game may be entered upon the occurrence of a special start-bonus game outcome (e.g., symbol trigger, mystery trigger, time-based trigger, etc.) in or during the basic wagering game. Alternatively, the illustrated game may be a stand-alone wagering game.

In the illustrated bonus game, a player selects, one at a time, from the array of markers 94 to reveal an associated bonus-game outcome. According to one embodiment, each marker 94 in the array is associated with an award outcome 96 (e.g., credits or other non-negative outcomes) or an end-game outcome 98. In the illustrated example, a player has selected an award outcome 96 with the player's first two selections (25 credits and 100 credits, respectively). When one or more end-game outcome 98 is selected (as illustrated by the player's third pick), the bonus game is terminated and the accumulated award outcomes 96 are provided to the player.

Figure 5:
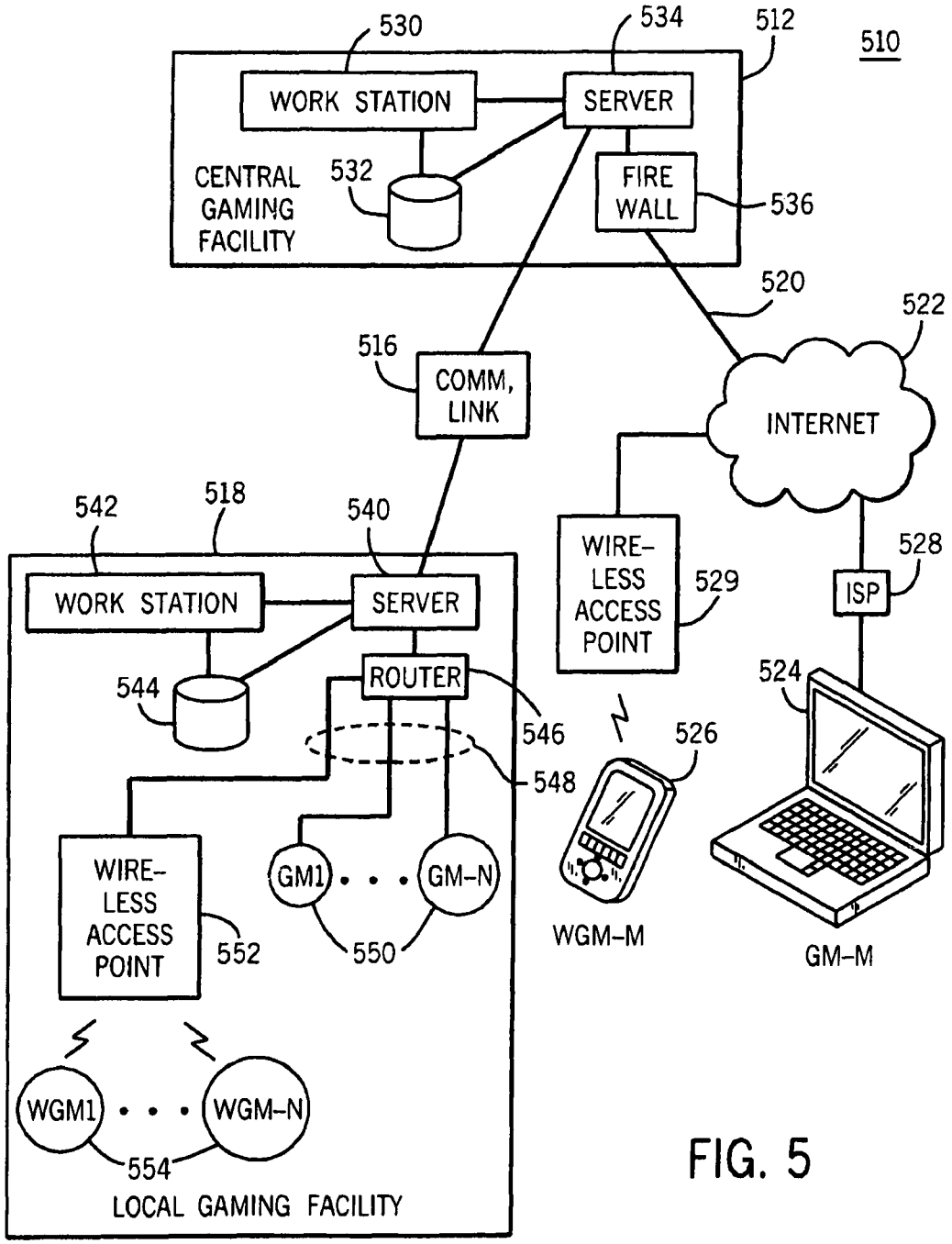
FIG. 5 is a diagram of a gaming system for executing and displaying multi-tiered competitive wagering games.

Referring now to FIG. 5, an exemplary gaming system 510 includes a central gaming facility 512 connected by communication link 516 to a local gaming facility 518, e.g. a casino, and by link 520 with the internet 522. End user computing devices including a gaming machine or terminal GM-M 524, e.g. a laptop computer, and wireless gaming machine or terminal WGM-M 526, e.g. a personal digital assistant (PDA), function as clients of the central gaming facility 512. Laptop 524 is coupled via internet service provider 528 and the internet 522 with the central gaming facility 512. The PDA 526 is connected with a wireless link by the wireless access point 529 and internet 522 to the central gaming facility 512. As used herein, "gaming" refers to the use of various games that support the placing of wagers on the outcome of the games, e.g. a video poker machine.

The central gaming facility 512 may represent a control location of a gaming business operator that supports individual gaming users, e.g. users of PDA 526 and laptop 524, as well as other gaming facilities of the operator such as casino 518. The central gaming facility 512 in this illustrative example may be geographically separated from the casino 518 and the individual users. The central gaming facility 512 includes a workstation 530 supported by data storage element 532 and a server 534 that serves as a communication host for casino 518 and the individual users via firewall 536. Requests for information and/or data received from the individual users are processed by server 534. The requested information and/or data may be obtained from support resources, e.g. workstation 530 and data residing in storage element 532. The requested information is sent from the server 534 to the requesting user's devices.

The local gaming facility 518 represents a casino and includes a server 540 supported by a workstation 542, data storage element 544 and a router 546. The router 546 supports communications with different gaming machines or terminals GM(1)-GM(N) 550 by wired links 548. A wireless access point 552 is connected by a wired link 548 to router 546 and by wireless communication links to wireless gaming machines or terminals WGM(1)-WGM(N) 554.

At least some of the gaming machines 550 and some of the wireless gaming machines 554 support the play of wagering games in which the user's gaming machine functions in the client/server communication model with the user's gaming machine being a client of server 540. The user's gaming machine contains software which is responsible for the ongoing play of the wagering game. However, some information or data associated with the play of the game may be obtained during the ongoing play of the game from server 540. Thus, the gaming system 510 displayed and described may be configured to execute and display a variety of primary wagering games and multi-tiered competitive wagering games on the terminals [GM(1)-GM(N) 550, WGM(1)-WGM (N) 554, GM-M 524, and WM-M 526], as explained further herein.

Figure 6:
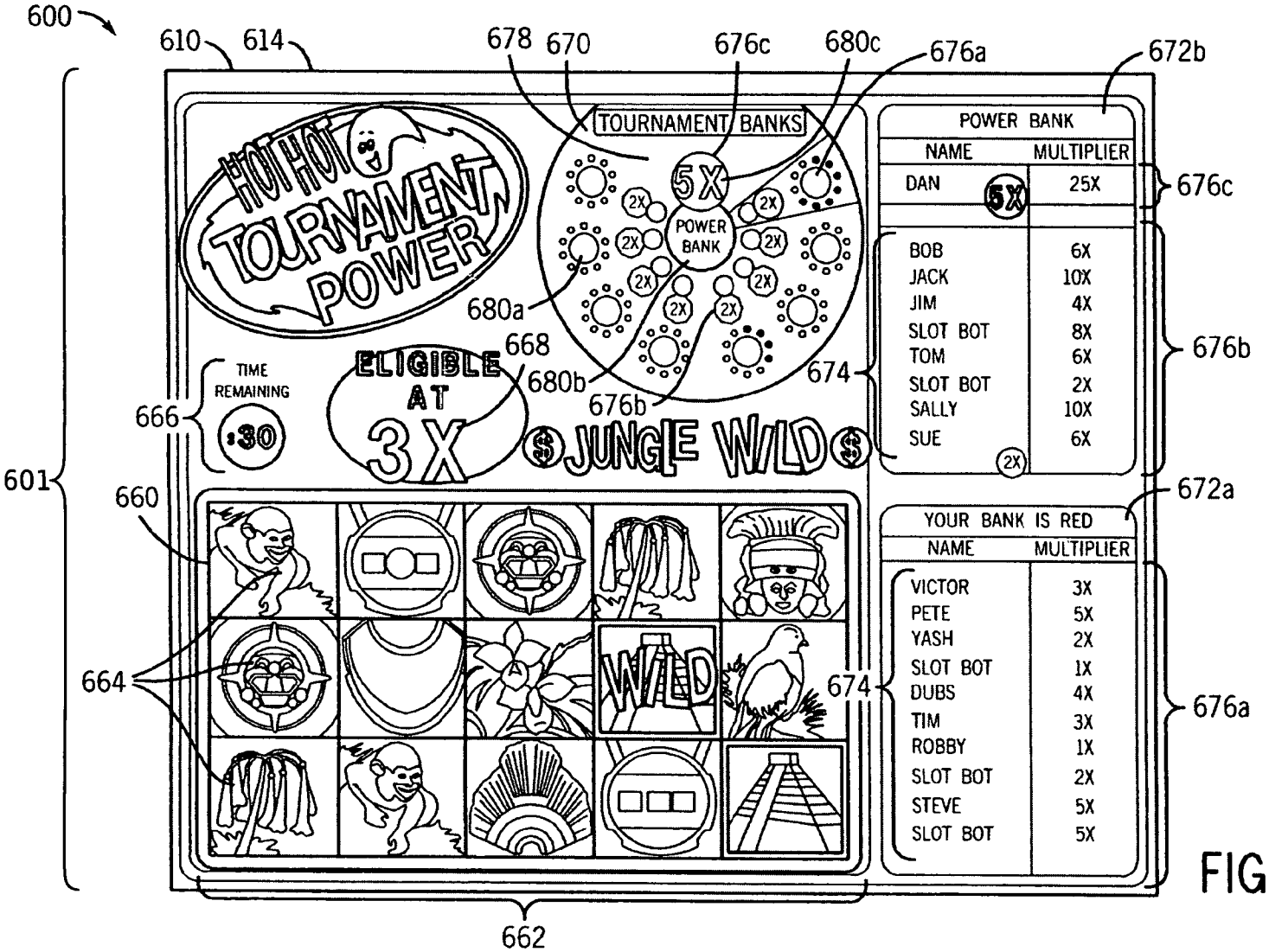
FIG. 6 is a screen shot of a first or primary configuration of a wagering game.

Turning to FIG. 6, a screen shot of a first configuration 601 of a wagering game is shown. In the first configuration 601, a primary display 614 of a gaming device or terminal 610 of a gaming system 600 (such as the exemplary gaming system in FIG. 5) is shown displaying a primary wagering game 660. The device or terminal 610 may be a freestanding gaming device as seen in FIG. 1*a*, a handheld device as seen in FIG. 1*b*, or any other device having a display 614. In this embodiment, the primary wagering game 660 is a slot game and comprises a plurality of symbol bearing reels 662 which are spun and stopped to reveal combinations of symbols 664 which are evaluated for winning combinations. The primary display 614 further displays portions of a secondary wagering game 670, which is a competitive wagering game. The secondary wagering game 670 includes one or more leader boards 672*a,b* which display the performance of a plurality of players 674 in the secondary wagering game 670. The secondary wagering game 670 includes a plurality of tiers 676*a, b,c* which may be displayed using the lead boards 672*a,b* or other graphics such as a visual map 678. In this embodiment, the visual map 678 includes depiction of a plurality of groups or virtual banks 680*a,b,c* corresponding to the plurality of tiers 676*a,b,c* or levels in the secondary wagering game 670. The primary display 614 also displays an eligibility and trigger meter 666 which informs the player as to the player's individual award portion 668 which in this case is a multiplier, and the player's eligibility time remaining in the event that an occurrence of the secondary wagering game 670 is triggered. Thus, the first configuration 601 includes the primary and secondary wagering games 660,670 and other graphics described.

Figure 7:
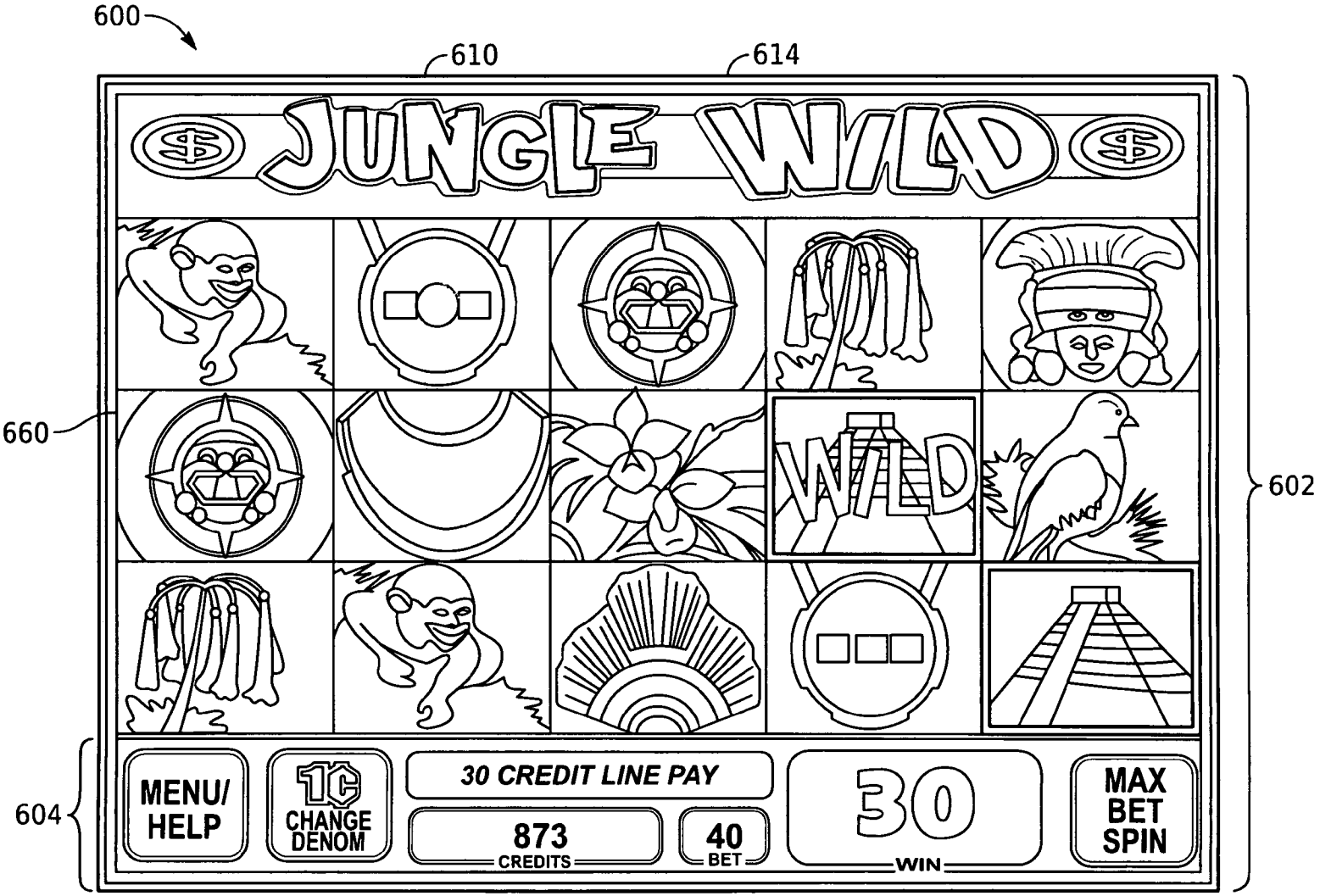
FIG. 7 is a screen shot of a secondary or alternate configuration of the wagering game of FIG. 6.

In FIG. 7, a second or alternate configuration 602 of the wagering game from FIG. 6 is displayed. In the alternate configuration 602, the primary display 614 continues to display the primary wagering game 660 which is a slot game. However, the secondary wagering game 670 has been removed from the primary display 614. Thus, the primary wagering game 660 has been expanded to fill the majority of the primary display 614 screen area. The alternate configuration 602 of the wagering game also includes a button panel 604 along the bottom of the display 614. In the embodiments depicted in FIGS. 6 and 7, the secondary wagering game 670 is a community game which requires a connection from the local gaming terminal 610 to one or more servers (not shown) similar to the system shown in FIG. 5. In an embodiment, the primary wagering game 660, however, is processed and determined locally, for example by one or more processors in the local terminal 610. Thus, in one embodiment, a loss of communication between the gaming terminal 610 and one or more servers of the system 600 may cause an inability to process and display the secondary wagering game 670. For example, if the communication between the gaming terminal 610 and the server is over a wireless network or link, interference may interrupt the transmission or receipt of required information. In a wired scenario, physical damage to one or more components of the network, network wiring, routers, or servers may cause the interruption.

Therefore, in one embodiment, the gaming system 600 monitors and detects communications between the local gaming terminal 600 and servers, networks, and other components (such as those in FIG. 5) with which it needs to communicate in order to function as intended. When a loss of communication is detected, the system 600 may cause the gaming terminal 610 to shift from displaying the first configuration 601 of the wagering game to an alternate configuration 602 of the wagering game. In one embodiment, the first configuration 601 includes at least one component which requires, and is dependent upon, an active and reliable connection with a network, server, or other remote component, while the second or alternative configuration 602 is capable of being displayed by the gaming terminal 610 as a standalone device. Thus, in the embodiment shown in FIGS. 6 and 7, a detected loss in communications with a required network (on which the secondary wagering game 670 depends) has caused the gaming terminal 610 to cease display of the first configuration 601 and begin display of the second configuration. The system 600 may operate in the reverse such that when a reconnection of the terminal 610 with the necessary networked components is detected, the system 600 may automatically cause the primary display 614 to revert to displaying the first configuration 601. Thus, in an embodiment, the first configuration 601 is a default or preferred configuration while the second or alternative configuration 602 is a fall back configuration.

Returning to FIG. 5, in one embodiment, the gaming system 510 monitors communications between gaming terminals 550,554 and the server 540 by monitoring the wired links 548, wireless access point 552, and router 546. In other embodiments, one or more of the configurations of wagering games displayed on the terminals 550,554 may require further communication to the central gaming facility 510 such that the system 510 also monitors the communication link 516. Moreover, to the extent that one or more configurations of the wagering games are displayed on wireless devices 526 and laptop computers 524 connected with the central gaming facility 512, the system 510 further monitors communications conducted via link 520, the internet 522 and ISP 528, and wireless access points 529.

One or more sets of rules may be used and applied by the system 510 so as to monitor, regulate, and control the various configurations of wagering games available to be displayed on the gaming terminals 550,554,524,526. For example the rules may be used to instruct the gaming terminals 550,554, 524,526 as to when and how to change from displaying a first configuration of a wagering game to a second, third, fourth, etc. configuration. For example, in one embodiment, the first configuration may require connection to the central gaming facility 512, while a second configuration requires communication to a local server 540, while a third configuration is a standalone configuration in the event that all communications are lost to a gaming terminal 550,554,524,526. Moreover, the rules may be used to implement various eligibility criteria, thereby making the rules conditional rather than automatic. For example, the first configuration in the above example may be only implemented if a player at a gaming terminal 550, 554,524,526 has selected to activate a game or feature which requires a connection to the central gaming facility 512. If not, the second configuration is used.

In yet other embodiments, other events may trigger the transfer or change from one configuration of a wagering game to a second configuration of a wagering game. For example, the system 510 may monitor and detect loss of a system resource and change configurations based upon that occurrence. In one embodiment, if a system resource such as a speaker or audio system, a transmissive LCD, or other hardware/software is lost at the local gaming terminal, the system 510 causes a change in configuration of the wagering game. For example, a first configuration dependent upon the audio system which is malfunctioning may be changed to a second configuration capable of running without the need for the system resource which has been lost, in this case audio. In another example, if one configuration of a displayed wagering game includes a link to a progressive jackpot (for example five like "Top Award" symbols aligned on a pay line award a progressive jackpot), and a loss of communication to the progressive link is detected, the configuration may be changed such that the wagering game appears the same, but now five "Top Award" symbols pays a fixed jackpot stored locally on the gaming terminal. Loss of many other types of system resources may trigger the shift in configuration. For example the system 510 may monitor and change configurations based upon loss of the following system resources: audio devices (speakers, amplifiers, drivers, cables, switches), video devices (displays, video cards, drivers, cables, switches), and input devices (touch screen, buttons, levels, joystick, trackball, mouse, etc.) The system resources may further include peripherals such as ticket printers, bar code readers, card readers, scanners.

In other embodiments, a variety of measures may be employed by the system 510 with respect to a wagering game in progress at the time the system 510 detects the loss in communication or other triggering event. For example, in the example depicted in FIG. 6, if a player is in the middle of playing the secondary wagering game 670 when communications with the server running the secondary wagering game 670 are lost, the system 510 must compensate. In one embodiment, the play of the secondary wagering game 670 is archived and stored on the server, and replayed at a later time when communications with the gaming terminal are re-established. A ticket, card or other item may be provided to the player which is encoded so as to retrieve the play of the secondary wagering game 670. This would permit the player, for example, to go to a different gaming terminal (which has not lost connection) and recall and observe the outcome of the play of the secondary wagering game. The ticket or card may include a disclaimer printed thereon stating that if the play of the game is not redeemed within a certain amount of time, it is forfeited. If the system 510 monitors players by assigning each a player account, the system 510 may simply store and award the outcome of the play which the player can retrieve at their leisure.

In another embodiment, the play of the game may be abandoned. In such a configuration, any wager or entry fee may be returned or credited to the player to return the player to the state prior to entry into the secondary wagering game 670. Moreover, the system 510 may monitor various system components to ensure that the player has not deliberately contributed to the triggering event, for example a loss of communication. In one such embodiment, a player engaged in a secondary wagering game 670 but not receiving a desirable result might purposely tamper with the connection or other hardware in an attempt to trigger the change to an alternate configuration. By monitoring various components, the system 510 may detect (as best as possible) if the player initiated the triggering event through malfeasance.

When the system 510 detects restoration of the lost connection or system resource, a variety of things may occur. In one embodiment, the system 510 may automatically return to the first configuration (that prior to the event triggering the change. In another embodiment, the system 510 may have another default configuration which is initiated upon restoration of the communication or system resource. The player may be informed of the change via graphics, sounds, or other announcements. Alternatively, the change from one configuration to another may not be announced (and may even be unnoticed or transparent to the player). In another embodiment, even after restoration the player continues in the then-current configuration until he voluntarily selects to return to the prior configuration. Moreover, a player may use a player account to set preferences related to changes in configuration, and the system 510 may follow those preferences once restoration occurs.

In one embodiment, if the lost connection or resource eliminates communication with a remote random number generator, the system 510 may switch the configuration to a local random number generator without changing the appearance of the wagering game. Thus, in one embodiment, a change from one configuration to another does not include a visual change, but merely a change from reliance upon a remote resource to reliance upon a local one. A lost connection with a remote random number generator may cause the remote random numbers generated to be cached and stored for future recall and use, either in the same wagering game or configuration, or in another.

In another alternative embodiment if a group or "bank" of gaming terminals participating, for example, in a bank wide event or game loses connection with a required server, the system 510 may perform a number of actions. First, the bank wide event or game may be cancelled. Alternatively, the bank wide event or game may be cached and stored for future display. This may include storing player selections, wagers and other inputs in a history file or log, such that they may be accurately replayed upon restoration. Wagers input into the bank-wide event or game after loss of connection may be accounted for in meters or accounts separate from those generally used for such purpose. For example, local processors and/or memory in the bank (or in one of the terminals therein) may perform the accounting functions and store the required information until reconnection occurs. In one embodiment, if a certain number of gaming terminals in the group or bank lose connection, the server may shut down the group or bank, and may optionally "move" on to another group or bank for purposes of conducting the games or additional features stored thereon.

Returning to FIG. 5, in some events triggering loss of connection or system resources, one or more gaming terminals may lose connection (requiring a change in configuration as described), while others may not. For example, assume that a first player at a wireless gaming device 554 and a second player at a free standing gaming terminal 550 are engaged in the same community event, for example a secondary wagering game. The first player loses connection with the wireless access point 552, and as a result his gaming device 554 changes from displaying the event to displaying only a locally executed base wagering game (thus, a change from one configuration to another). The second player continues in the community event since he has experienced no loss in connection.

In one embodiment, the system 510 compensates for the lost player by creating a virtual replacement player who continues in the shoes of the first player. This may appear transparent to the remaining players (like the second player) who may not even be aware that the first player has dropped out of the community event. The system 510, in operating the virtual player, may ante or place any necessary wagers, make selections for the virtual player, and perform any other tasks required in playing or participating in the community event. If the community event is a passive game (the players make no active selections or inputs), a virtual player may not be required, but rather a graphical representation of the first player (now disconnected) may be allowed to continue. As the players watch the event unfold, and the results are tallied, any awards earned by the first player may be stored in his account, in memory, or on a ticket or card, and provided to the first player at a later time, whether or not reconnection occurs.

In other embodiments, a system 510 having a server having lost connections with one or more players may compensate in other ways. For example, the system 510 may issue special offers to other players to incentivize them to join the wagering game(s) from which other players lost connection, such that a required amount of players in a group or bank is achieved. The system 510 may also perform load balancing routines in an effort to compensate for lost players. For example, remaining players may be permitted to have multiple entries into the game to compensate for lost players. This may be voluntary or it may be automatic (for example, server "doubles up" players by virtually assigning two players to each gaming device playing the game).

In an embodiment, both the gaming terminals 550,554, 524,526 and the servers 540,534 of the system 510 have loaded the same set of rules for changing configurations. Thus, when a terminal 550 loses connection with a server 540, for example, not only does the terminal 550 change configurations as described herein (for example with reference to FIGS. 6 and 7), but the server 540 also makes changes in an effort to preserve its operation (for example the incentivizing and load balancing techniques described). In this way, by using the same rule sets, the server 540 and remainder of the system 510 may be aware of the current configuration of terminal 550 from whom a connection is lost, even though they are not in communication with one another.

The systems described may provide a number of ways to create and store various alternative or "fallback" configurations of wagering games which are activated upon certain triggering events. For example, an operator may use one or more interfaces in communication with the server 540 to create such primary and secondary (or alternative) configurations, and store them on the server 540. The interface, for example, may be in the form of a display screen and input devices (keyboard, mouse, etc) of an operator control computer in communication with the server 540. In an alternative embodiment, the interface maybe an administrative screen or input interface on one or more of the gaming terminals 550, 554,524,526, or on other computers of the system. Once the various configurations are created and stored on the server 540, an operator may then specify one or more rule sets to use which controls the determination of which configuration of a wagering game is activated. In one embodiment, the rule set may be created automatically depending on the needs of the various available configurations. For example, one primary configuration may be the activation of a particular primary wagering game with a plurality of secondary features available, such as secondary wagering games, portal features, or side wager events. The secondary features may depend on communication with a central game controller remote from the gaming device. Thus, a secondary or alternative configuration may comprise display and execution of only the primary wagering game (base game) without the secondary features. The rule set activated by an operator, or generated automatically, would include instructions to activate the primary configuration unless communication with the central game controller is lost, at which time the secondary (or alternate) configuration would be activated.

The system and methods of the present invention offer substantial benefits to players and operators alike. By changing from one configuration of wagering game to another when a lost connection or system resource is detected, the system permits players to continue playing wagering games with little or no interruption. A player on a disconnected terminal may continue by playing an alternate configuration of a game. At the same time, a server and players of group games may continue playing without being affected by the loss of one or more players in the group or bank. By minimizing interruption from such lost connections and system resources, the system and methods permit maximum game play to continue and thus maximum revenue to gaming system operators. Other benefits are provided as well.

Each of these embodiments and obvious variations thereof is contemplated as falling within the spirit and scope of the claimed invention, which is set forth in the following claims.

What is claimed is:

1. A method of conducting a wagering game including a primary game and a secondary game, the method comprising:

presenting, via a gaming machine configured for communication with a game server, a first configuration of the wagering game, wherein the secondary game in the first configuration includes one or more features that change in response to receiving feature information from the game server;

detecting a loss of communication between the gaming machine and the game server; and in response to detecting the loss of communication, presenting, via the gaming machine, a second configuration of the wagering game, wherein the secondary game in the second configuration is modified in accordance with an absence of the feature information from the game server, and the second configuration of the wagering game is executed locally by the gaming machine.

2. The method of claim 1, wherein the gaming machine and the game server are connected via a wired or wireless link, the method further comprising detecting re-establishment of communication between the gaming machine and the game server, wherein the gaming machine is located in a local gaming facility, and wherein the game server is located at the local gaming facility or at a central gaming facility geographically remote from the local gaming facility.

3. The method of claim 1, wherein the secondary game in the first configuration includes a game outcome that is selected by a random number generator in the game server, and wherein the secondary game in the second configuration includes a game outcome that is selected by a local random number generator in the gaming machine.

4. The method of claim 1, wherein the secondary game in the first configuration is associated with a progressive jackpot that is determined by the server, and wherein the secondary game in the second configuration is associated with a fixed jackpot stored locally on the gaming machine.

5. The method of claim 1, wherein the second configuration is modified by removing the secondary game from the wagering game.

6. The method of claim 2, further comprising, in response to detecting reestablishment of communication, presenting the first configuration of the wagering game via the gaming machine.

7. The method of claim 5, wherein the secondary game is a competitive wagering game that displays performances of a plurality of players in the secondary game.

8. The method of claim 7, wherein the secondary game is stored, executed or processed on the game server.

9. A gaming system configured to conduct a wagering game including a primary game and a secondary game, the system comprising:

at least one gaming machine configured for communication with a game server;

one or more a display devices;

one or more processors; and at least one memory device storing instructions that, when executed by the one or more processors, cause the gaming system to:

present, via the at least one gaming machine, a first configuration of the wagering game, wherein the secondary game in the first configuration includes one or more features that change in response to receiving feature information from the game server;

detect a loss of communication between the at least one gaming machine and the game server; and in response to detecting the loss of communication, present, via the at least one gaming machine, a second configuration of the wagering game, wherein the secondary game in the second configuration is modified in accordance with an absence of the feature information from the game server, and the second configuration of the wagering game is executed locally by the at least one gaming machine.

10. The gaming system of claim 9, wherein the instructions at further cause the gaming system to detect re-establishment of communication between the at least one gaming machine and the game server and, in response to detecting re-establishment of communication, present, via the at least one gaming machine, the first configuration of the wagering game.

11. The gaming system of claim 10, wherein the gaming system includes a bank of at least two gaming machines, and wherein the instructions further cause the gaming system to, in response to detecting a loss of communications to at least one gaming machine of the bank, present the second configuration via all the gaming machines of the bank.

12. A method of playing a wagering game comprising:

executing and presenting a first configuration of the wagering game on a gaming terminal, the first configuration relying upon a system resource of the gaming terminal in order to be presented on the gaming terminal;

detecting a loss of a system resource of the gaming terminal; and in response to detecting the loss of the system resource, changing the first configuration to a second configuration and executing and presenting the second configuration of the wagering game on the gaming terminal without the availability of the system resource, wherein the first configuration differs from the second configuration.

13. The method of claim 12, further comprising detecting re-establishment of the system resource of the gaming terminal, and, in response thereto, executing and presenting the first configuration of the wagering game on the gaming terminal.

14. The method of claim 12, wherein the system resource is an audio device, a video device, an input device, a software component, or a peripheral.

15. The method of claim 13, wherein the system resource is a link to a progressive jackpot, wherein the first configuration relies on the link to the progressive jackpot to award the progressive jackpot, and wherein the second configuration does not rely on the link to the progressive jackpot and instead stores a fixed jackpot locally in the gaming terminal.

16. A gaming system comprising:

at least one gaming machine including a display device for displaying a wagering game, the at least one gaming machine further comprising a plurality of system resources;

one or more processors; and at least one memory device storing instructions that, when executed by the one or more processors, cause the gaming system to:

(i) determine which of the plurality of system resources are operational;

(ii) select a configuration of the wagering game, wherein the selected configuration is operable to present the wagering game in accordance with the operational system resources; and (iii) execute the wagering game according to the selected configuration of the wagering game.

17. The gaming system of claim 16, wherein the instructions further cause the gaming system to:

(iv) detect a malfunction of a first one of the operational system resources;

(v) select an alternate configuration of the wagering game, wherein the alternate configuration is operable to present the wagering game in accordance with the remaining operational system resources; and (vi) execute the wagering game according to the selected alternate configuration.

18. The gaming system of claim 16, wherein the plurality of system resources are selected from the group consisting of audio devices, video devices, input devices and peripherals.

19. The gaming system of claim 16, wherein the configurations are selected in accordance with at least one rule set stored in memory on the at least one gaming machine.

20. A gaming system comprising:

a game server communicating with a plurality of gaming machines, each of the plurality of gaming machines configured to participate in a community wagering game;

at least one data storage element in communication with the game server, the at least one data storage element storing at least one primary wagering game playable on any of the plurality of gaming machines;

one or more processors; and at least one memory device storing instructions that, when executed by the one or more processors, cause the gaming system to:

(i) present a first configuration of the community wagering game and transmit information related thereto to each of the plurality of gaming machines;

(ii) monitor a connection between the game server and each of the gaming machines of the plurality;

(iii) detect a loss of communications between a first one of the plurality and the game server;

(iv) in response to detecting the loss of communications, modify the first configuration of the community wagering game to produce a second configuration, wherein the community wagering game in the second configuration is modified in accordance with the absence of the first one of the plurality; and (v) present the second configuration of the community wagering game to the plurality of gaming terminals except for the first one of the gaming terminal.

21. The gaming system of claim 20, wherein modifying the first configuration of the community wagering game comprises activating at least one virtual player.

22. The gaming system of claim 20, wherein modifying the first configuration of the community wagering game comprises load balancing the remaining gaming machines of the plurality of gaming machines.

23. The gaming system of claim 20, wherein at least one of the plurality of gaming machines communicates with the gaming server via a wireless link.

24. The gaming system of claim 20, wherein the at least one data storage element further stores at least one rule set for modifying the configuration of the community wagering game.

25. The gaming system of claim 24, wherein the at least one rule set is stored in memory of the first one of the gaming machines.

* * * * *